United States Patent [19]

Freeman

[11] 4,444,480

[45] Apr. 24, 1984

[54] ROTATING DRUM-CONTAINING SHEET OR WEB PROCESSING APPARATUS

[75] Inventor: Barrie A. Freeman, Wickford, England

[73] Assignee: Ciba-Geigy AG, Basel, Switzerland

[21] Appl. No.: 438,840

[22] Filed: Nov. 3, 1982

[30] Foreign Application Priority Data

Apr. 11, 1981 [GB] United Kingdom ..... 8133188

[51] Int. Cl.[3] ..... G03D 3/04; G03D 3/08

[52] U.S. Cl. ..... 354/329; 354/316

[58] Field of Search ..... 354/308, 312, 313, 316, 354/328, 329, 330, 320, 322, 323, 324

[56] References Cited

U.S. PATENT DOCUMENTS

| | | | |
|---|---|---|---|
| 3,623,416 | 11/1971 | Anderberg | 354/324 |
| 3,673,985 | 4/1972 | Dols | 118/637 |
| 3,693,529 | 9/1972 | Stabler | 354/330 |
| 3,727,535 | 4/1973 | Streeter | 354/329 |
| 4,152,066 | 5/1979 | Deboute | 354/330 |
| 4,269,501 | 5/1981 | Griffith | 354/330 |

FOREIGN PATENT DOCUMENTS

| | | | |
|---|---|---|---|
| 2615932 | 7/1977 | Fed. Rep. of Germany . | |
| 1310689 | 5/1973 | United Kingdom . | |
| 1494737 | 12/1977 | United Kingdom | 354/329 |

*Primary Examiner*—A. A. Mathews

*Attorney, Agent, or Firm*—Harry Falber

[57] ABSTRACT

A drum processing apparatus for sheet or web material is described wherein the drum also acts as a solution recirculating means.

The apparatus comprises a vessel containing processing liquid in which is partially immersed a driven drum which guides the sheet or web material through the vessel. The drum comprises within its body at least one cavity, there being at least two apertures which lead from said cavity to the outside of the drum. The cavity is so formed and the apertures are so located that, when the drum rotates, a body of liquid from the vessel enters the cavity through one aperture at a lower level in the vessel, is raised to a higher level in the vessel, and leaves the cavity at the higher level through the other aperture. Thus the liquid is circulated in the vessel.

6 Claims, 4 Drawing Figures

ROTATING DRUM-CONTAINING SHEET OR WEB PROCESSING APPARATUS

This invention relates to photographic processing apparatus.

In the past photohobbyists and professional photographers who process their own prints have relied on dish processing without any form of automation of the processing. However in recent years there has arisen the need to provide at least semi-automatic photographic processing apparatus for such users. One of the prime considerations for such apparatus is the need to keep the cost as low as possible. Solutions for example photographic silver halide developing solutions, fixing solutions and bleach solutions are in most photographic processing apparatus retained in baths through which the photographic material is passed or in which a rotating roller applies the solution to the photographic material. In both cases it is necessary that the solution in the bath is continuously recirculated to avoid pockets of liquid in the bath which have become exhausted of the active ingredient or badly contaminated with waste products of the processing reaction, also to give uniform temperature throughout the bath. However recirculating pumps are comparatively expensive and form a considerable part of the cost of a small photographic processing apparatus.

We have discovered a simple inexpensive solution circulating means which can be used in a sheet or web processing apparatus.

According to the present invention in a processing apparatus for sheet or web material there is provided a vessel containing processing liquid in which is partially immersed a driven drum which helps to guide the sheet or web material through the vessel, the said drum comprising within its body at least one cavity, there being at least two apertures which lead from the cavity to the outside of the drum, the said cavity being so formed and the said apertures being so located that when the drum is rotating a body of liquid from the vessel enters the cavity through one aperture at a lower level in the vessel, is raised to a higher level in the vessel and leaves the cavity at the higher level through the other aperture, thus circulating the liquid in the vessel.

The apparatus of the present invention is of particular use for the processing of photographic sheet material where sheets of exposed photographic material are rotated in photographic processing baths by drums partially immersed in the baths the sheet material adhering to the face of the drum.

However the processing apparatus of the present invention can also be used to process web or sheet material wherein the processing solution is applied to the face of the web or sheet from a driven drum which picks up the solution from the vessel.

It is an essential feature of the processing apparatus of the present invention that a body of processing liquid is taken from one level in the vessel is raised and then re-enters the vessel at a higher level. This displacement of the liquid causes the liquid in the vessel to continuously recirculate and thus prevent any pockets of liquid which have become more contaminated or more exhausted than the remainder of the liquid in the vessel from forming.

Hollow drums have been used in the processing of electrophotographic material to prevent the material from adhering to the surface of the drum which is usually the electrode. For example in German O.L.S. No. 2010736 liquid is pumped from a pipe in the center of the drum through a large number of orifices in the surface of the drum. In U.S. Pat. No. 3,673,985 a hollow drum with a number of vanes inside it is caused to rotate rapidly in a developing liquid processing bath. This rapid rotation of the drum causes the drum to act like a vane pump and force liquid out of a large number of orifices in the surface of the drum. In neither case is liquid taken into the hollow drum at one level and raised to a higher level and then discharged from the drum.

In one embodiment the cavity in the drum is so formed that the liquid enters the drum at one end and leaves the drum at the other end.

However in another embodiment the liquid enters the cavity from both ends of the roller and leaves the cavity through a slot on the outside surface of the roller.

Most preferably a driven drum is used there being a dividing wall or septum which divides the drum diametrically into two halves. Each of these halves constitutes a cavity and one or both of these cavities may be used.

When such a drum is used preferably there is present in each half one aperture at one drum end located towards the periphery of the drum close to the dividing wall and one aperture at the other drum end located towards the periphery and diametrically opposite the aperture also close to the dividing wall.

Thus depending on the direction of rotation of the drum two of the apertures are liquid filling apertures and the other two apertures are liquid emptying apertures.

However when the liquid level in the processing vessel is such that only a small part of the roller is immersed therein at any one time conveniently the drum may be divided into four cavities with appropriately located apertures.

In operation as the drum is rotated and a liquid filling aperture becomes immersed in the liquid liquid enters into the cavity through this aperture, then as the roller continues to rotate this body of liquid is trapped in the cavity and is raised until the level of liquid in the cavity is above the level of the liquid in the vessel, then this raised liquid is able to escape from the cavity via the second aperture. Thus liquid is drawn from one side of the vessel, is raised and then re-enters the vessel at the other side of the vessel, thus causing a very adequate recirculation of the liquid throughout the vessel. Thus in effect the driven drum acts as a recirculating pump.

It is possible to increase this recirculating effect by having two apertures in the other half of the drum these apertures being located in the opposite way to the apertures in the first half of the drum.

One great advantage of the processing apparatus of the present invention is the recirculation of liquid becomes more effective the slower the rotation of the drum. This is because at low rotational speeds more liquid will enter the cavity in the drum and be raised and then leave the drum. This very good recirculation of the liquid is obtained with a rotational speed of the drum as low as 10 r.p.m. This is to be compared with vane pumps and other forms of liquid circulation pumps which require either a high rotational speed or a high reciprocity speed to be effective.

The drum may be comprised of any suitable processing liquid-resistant material for example a plastics material for example polystyrene or acrylonitrile—butadiene—styrene or a metal for example stainless steel.

The accompanying drawings will serve to illustrate the invention.

In all the figures the same numbers bear the same signification.

Figure 1:
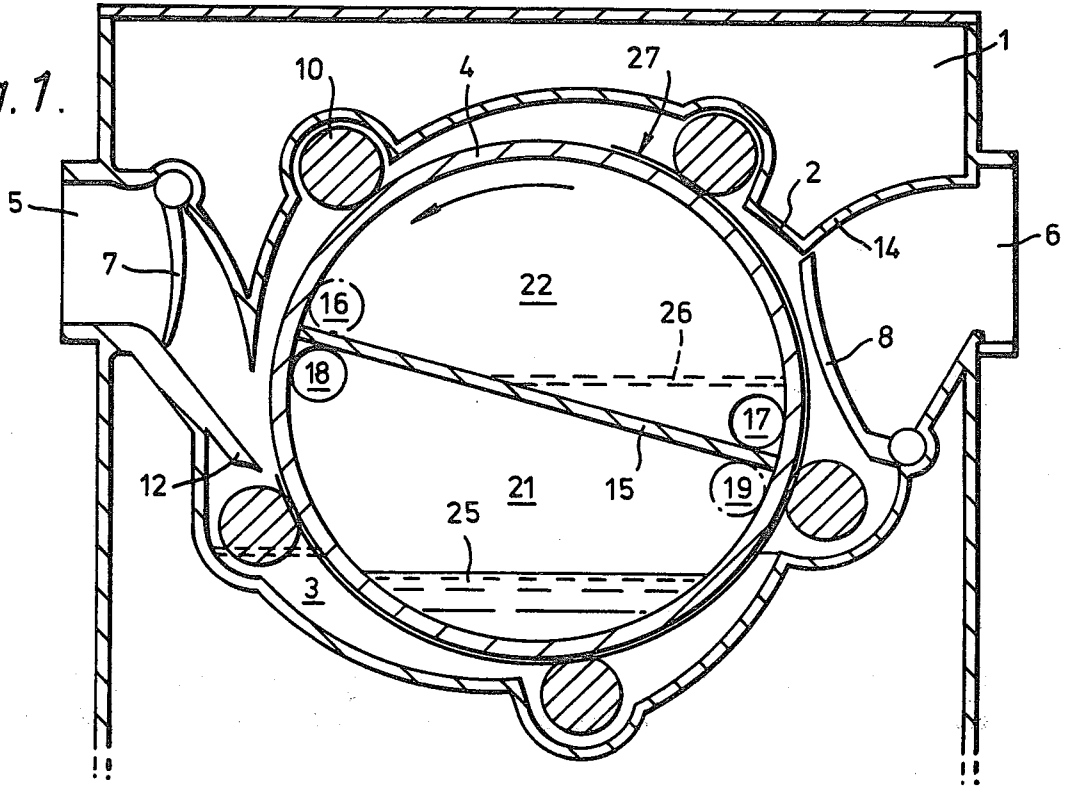
FIG. 1 is a cross-sectional side elevation of a processing apparatus of the present invention suitable for processing sheet of photographic material.

In FIG. 1 the processing device comprises a light-tight container 1 which comprises a light-tight shaped inner container 2 which is partially filled with processing solution 3. Partially immersed in the processing liquid 3 is a rubber-covered driven drum 4.

There is present on the left hand side of the figure a photographic material entry port 5 and on the right hand side of the figure a photographic material exit port 6. The entry port 5 is rendered light-tight by a pivotable member 7 which acts also to detect photographic material fed into the apparatus. The photographic material exit port is rendered light-tight by a pivotable member 8 which when caused to move in the direction shown by the arrow allows photographic material adhered to the surface of the drum 4 to peel away and out of the apparatus.

Arranged around the periphery of the drum are five idler rollers 10 which are retained in position by the inner container 2.

Present just inside the entry port 5 is a sheet material guide 12. Present above pivotable member 8 is a shaped guide 14 which is part of container 2.

Also present in drum 4 is a dividing septum 15. Also indicated in the figure are the positions of four apertures but these would not in fact be visible in this section because they are all located at one or other end of the drum.

Aperture 16 in dotted line is located at the near end of the drum. Aperture 17 in continuous line is located at the far end of the drum. Aperture 18 in continuous line is located at the far end of the drum and aperture 19 in outline is located at the near end of the drum.

Septum 15 divides the drum into two cavities 21 and 22.

Liquid 3 enters cavity 21 via aperture 19 and leaves via aperture 18. Liquid 3 enters cavity 22 via aperture 16 and leaves via aperture 17.

Shown in cavity 21 is the level of the liquid 25 in this cavity with the drum in the position shown in the figure. Shown in cavity 22 is the level of the liquid 26. Shown adhering to the surface of the drum is a sheet of photographic material 27.

In operation pivotable member 7 is opened by insertion of a sheet and pivotable member 8 is closed. Drum 4 is caused to rotate and the sheet of photographic material 27 is fed into the apparatus emulsion surface downwards.

Guide 12 guides the sheet material 27 under the surface of liquid 3 and onto the rotating drum 4. It is caused to adhere to the drum partly by suction and partly due to the presence of the five idler rollers 10. Member 7 closes as the trailing edge of the sheet enters the processor.

The sheet of photographic material 27 is driven round on the outside of drum 4 through the liquid 3 for sufficient time for the process to be effected. When sufficient time has elapsed or the calculated number of roller revolutions have taken place the pivotable member 8 is opened, this allows the sheet material to peel away from the drum and be deflected out of the apparatus via the exit port 6. The shaped part 14 of the inner container 12 serving to guide the sheet material 27 out of the apparatus.

In the position shown in the figure liquid 26 is leaving cavity 22 from aperture 17 and is almost dry. Liquid 25 is present in the cavity 21.

Then as the drum rotates further the body of liquid in cavity 21 will be raised until it can start to leave cavity 21 from aperture 18, even whilst aperture 18 is still submerged.

In this way processing solution is taken into the drum 4 from end, raised in level and leaves from the drum at the other end. This causes a good circulation of the liquid in container 2.

Figure 2:
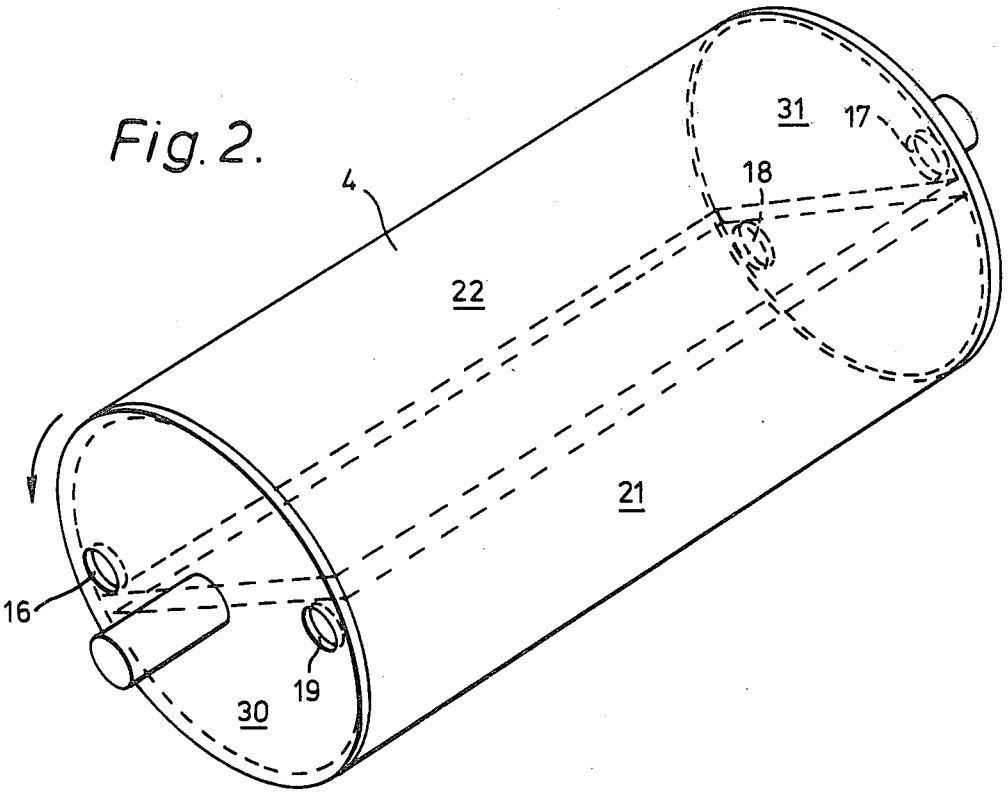
FIG. 2 is a perspective skeleton view of the drum shown in FIG. 1 showing the location of the aperture and the liquid level in the drum at one stage of the rotation of the drum.

In FIG. 2 drum 4 is shown removed from compartment 2. There is also shown the end faces 30 and 31 of drum 4. Thus cavity 21 is filled with liquid via aperture 19 which is on face 30 and liquid leaves from this cavity from aperture 18 which is in face 31.

Similarly cavity 22 is filled with liquid via aperture 16 which is on face 30 and liquid leaves from this cavity from aperture 17 which is on face 31.

Figure 3:
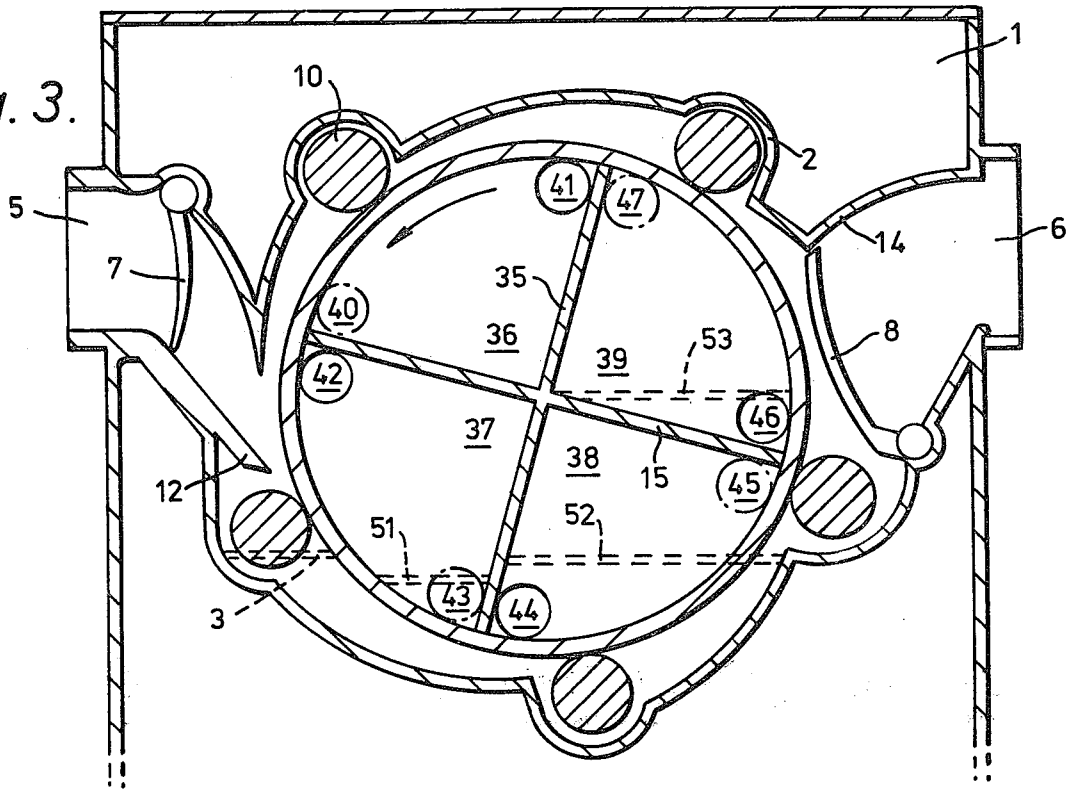
FIG. 3 is a cross-sectional side elevation of a processing apparatus similar to that shown in FIG. 1 but having a drum with four cavities.

In FIG. 3 is shown a similar processing apparatus to that in FIG. 1 except that drum 4 has been divided into four cavities by the presence of a second septum 35.

In this figure the apertures have been given different numbers and as have the cavities. Thus in this figure there are four cavities 36, 37, 38 and 39.

Cavity 36 is filled via aperture 40 and emptied via aperture 41. Cavity 37 is filled via aperture 43 and emptied via aperture 42. Cavity 38 is filled via aperture 45 and emptied via aperture 44 and cavity 39 is filled via aperture 47 and emptied via aperture 48.

The position as shown in FIG. 3 is that cavity 36 is empty of solution. Cavity 37 is being filled with liquid up to level 51. Cavity 38 is as full of liquid as it will be during the rotation of the drum and is full to level 52 which is the same as level 3. Cavity 39 has some liquid in it to level 53 and it is being emptied via aperture 46.

Then as the drum continues to rotate and the lower half of septum 38 reaches 5 o'clock the level of the liquid in cavity 44 will be raised above level 3 and liquid will start to leave cavity 38 and will be in the state as shown for cavity 39.

For low liquid levels four cavities may be used to achieve better efficiency but for liquid levels at or near the center line 4 of the drum only two cavities are required. The efficiency of pumping reduces proportionally to levels above the center line.

Figure 4:
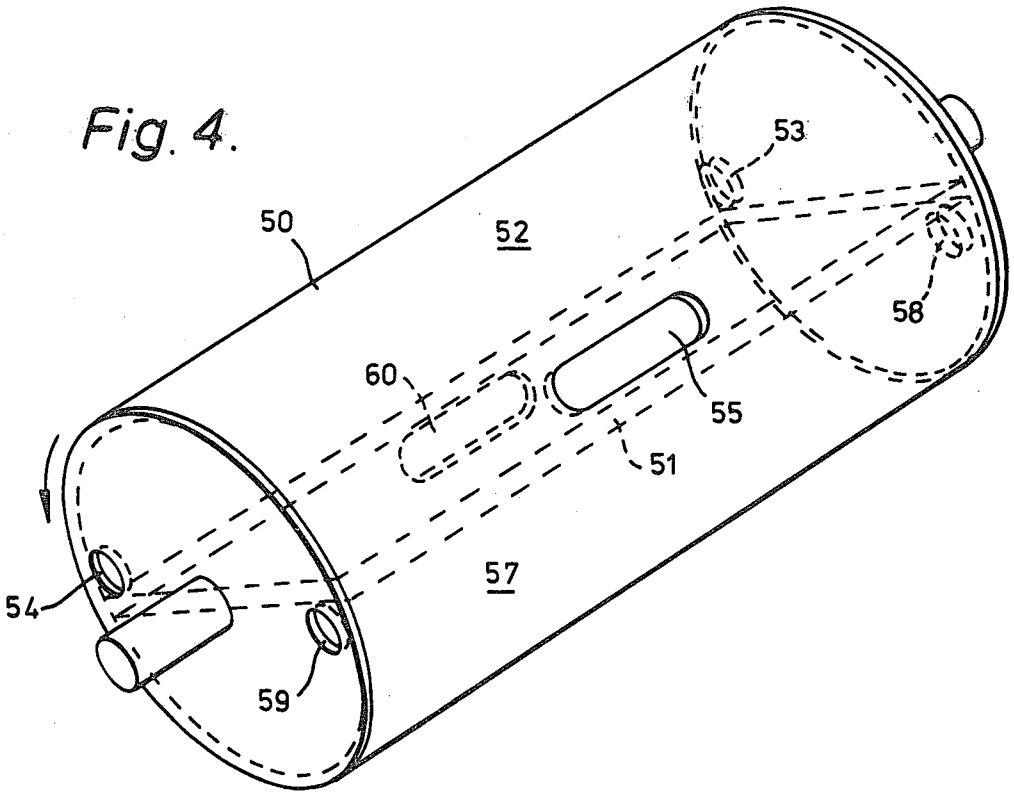
FIG. 4 is a perspective view of a drum which could be used instead of the drum shown in FIG. 2.

In FIG. 4 is shown a drum 50 which comprises a septum 51, present in cavity 52 above the septum are two apertures, aperture 53 being at the far end of the drum shown in dotted line and aperture 54 at the other end of the drum shown in outline. Present just above the septum 51 in cavity 52 is a slot 55 which leads from cavity 52 to the outside surface of drum 50.

Similarly present in cavity 57 below septum 51 are two apertures, aperture 58 being at the far end of the drum and shown in dotted line, and aperture 59 in outline which is at the near end of the drum. Present on the surface of the drum below septum 51 and leading from cavity 57 to the outside surface of drum 50 is slot 60 shown in dotted outline.

In operation when drum 50 rotates clockwise in the liquid in the liquid container, liquid enters cavity 52 via apertures 53 and 54, is raised and then leaves cavity 51 from slot 55.

Similarly liquid enters cavity 57 via apertures 58 and 59, is raised and leaves cavity 57 from slot 60.

Using an apertured drum of this type a better circulation of the liquid in the middle of the liquid container is obtained.

In practice it does not matter if one or both of the slots 55 and 60 are covered by photographic sheet material during a processing sequence because during processing for the majority of the time the drum will be rotating but no material will be present on the drum. During this time the processing solution will be recirculated as just described. When photographic material is over either of the slots some liquid will escape via the covered slots and some will escape from the liquid entry apertures. Thus liquid recirculation whilst the slots are covered will be less efficient than during the majority of the time when the slots are not covered.

I claim:

1. A processing apparatus for sheet or web material which comprises a vessel containing processing liquid in which is partially immersed a driven drum which helps to guide the sheet or web material through the vessel, the said drum comprising within its body at least a first and second cavity, each said first and second cavity having at least a first and second aperture positioned on opposing drum surfaces defining said first and second cavity, each said first and second aperture leading from its respective cavity to the outside of the drum, said first and second cavity being so formed and said first and second apertures being so located that when the drum is rotating, a body of liquid from the vessel enters one of said first and second cavity through said first aperture at a lower level in the vessel, is raised to a higher level in the vessel and leaves the said one cavity at a high level through the second aperture of said one cavity, thus circulating the liquid in the vessel.

2. A processing apparatus according to claim 1, wherein said first apertures are positioned on one end of each of said first and second cavity, and said second apertures are positioned on the other end of each of said first and second cavity, such that liquid enters one of said first and second cavities at one end and leaves from said one cavity at the other end.

3. A processing apparatus according to either claim 1 or claim 2 where there is a wall in the drum which divides the drum diametrically into two cavities.

4. A processing apparatus according to either claim 1 or claim 2 wherein the drum is divided by two dividing walls into four cavities.

5. A processing apparatus according to claim 1, wherein photographic material adheres to the surface of the drum as the drum rotates partially immersed in the processing liquid during the processing step.

6. A processing apparatus according to claim 1, wherein photographic material is passed over the surface of the drum as it rotates partially immersed in the processing liquid during the processing step.

* * * * *